US008314651B2

(12) United States Patent
Song et al.

(10) Patent No.: US 8,314,651 B2
(45) Date of Patent: Nov. 20, 2012

(54) INTERNAL VOLTAGE GENERATOR

(75) Inventors: Taek-Sang Song, Gyeonggi-do (KR); Dae-Han Kwon, Gyeonggi-do (KR); Jun-Woo Lee, Gyeonggi-do (KR)

(73) Assignee: Hynix Semiconductor, Inc., Gyeonggi-do (KR)

( * ) Notice: Subject to any disclaimer, the term of this patent is extended or adjusted under 35 U.S.C. 154(b) by 325 days.

(21) Appl. No.: 12/647,875

(22) Filed: Dec. 28, 2009

(65) Prior Publication Data

US 2011/0140768 A1 Jun. 16, 2011

(30) Foreign Application Priority Data

Dec. 14, 2009 (KR) ..... 10-2009-0123978

(51) Int. Cl.
*G05F 1/10* (2006.01)

(52) U.S. Cl. ..... 327/543; 327/538; 327/541

(58) Field of Classification Search ..... 327/538, 327/540, 541, 543
See application file for complete search history.

(56) References Cited

U.S. PATENT DOCUMENTS

| | | | | |
|---|---|---|---|---|
| 6,809,577 | B2 * | 10/2004 | Matsumoto et al. | 327/541 |
| 7,142,044 | B2 * | 11/2006 | Sano | 327/540 |
| 2004/0217804 | A1 * | 11/2004 | Moon et al. | 327/540 |
| 2007/0069808 | A1 * | 3/2007 | Do | 327/541 |

FOREIGN PATENT DOCUMENTS

| | | |
|---|---|---|
| KR | 100142958 | 8/1998 |
| KR | 100339970 | 6/2002 |

* cited by examiner

*Primary Examiner* — Long Nguyen
(74) *Attorney, Agent, or Firm* — IP&T Group LLP

(57) ABSTRACT

An internal voltage generator includes: a detection unit configured to detect a level of an internal voltage in comparison to a reference voltage; a first driving unit configured to discharge an internal voltage terminal, through which the internal voltage is outputted, in response to an output signal of the detection unit; a current detection unit configured to detect a discharge current flowing through the first driving unit; and a second driving unit configured to charge the internal voltage terminal in response to an output signal of the current detection unit.

14 Claims, 4 Drawing Sheets

INTERNAL VOLTAGE GENERATOR

CROSS-REFERENCE TO RELATED APPLICATIONS

The present application claims priority of Korean Patent Application No. 10-2009-0123978, filed on Dec. 14, 2009, which is incorporated herein by reference in its entirety.

BACKGROUND OF THE INVENTION

Exemplary embodiments of the present invention relate to a semiconductor device, and more particularly, to an internal voltage generator of a semiconductor device.

As semiconductor devices have been developed toward high-speed operation, low power consumption, and ultra fineness, operating voltages have also further lowered. Most semiconductor devices include an internal voltage generator configured to generate an internal voltage by using an external power supply voltage, so that the semiconductor devices are supplied with voltages for the operations of internal circuits for themselves. In designing such an internal voltage generator, a main issue is to constantly maintain an internal voltage at a desired level.

FIG. 1 is a circuit diagram of a conventional internal voltage generator.

Referring to FIG. 1, the internal voltage generator 100 includes first and second internal voltage driving units 110 and 120 configured to generate an internal voltage VINT corresponding to first and second reference voltages VREF_UP and VREF_DN. The first and second reference voltages VREF_UP and VREF_DN have equivalent voltage levels and correspond to a target voltage level of the internal voltage VINT.

The first internal voltage driving unit 110 includes a first comparator 112 and a pull-up driver 114. The first comparator 112 is configured to compare the first reference voltage VREF_UP with a fed-back voltage of the internal voltage VINT, and the pull-up driver 114 is configured to be driven in response to a first driving signal V1 outputted from the first comparator 112. The first comparator 112 is configured with a current mirror type differential amplifier, and the pull-up driver 114 is configured with a PMOS transistor coupled between a power supply voltage (VDD) terminal and an internal voltage (VINT) terminal and having a gate receiving the first driving signal V1 outputted from the first comparator 112.

The second internal voltage driving unit 120 includes a second comparator 122 and a pull-down driver 124. The second comparator 122 is configured to compare the second reference voltage VREF_DN with a fed-back voltage of the internal voltage VINT, and the pull-down driver 124 is configured to be driven in response to a second driving signal V2 outputted from the second comparator 122. The second comparator 122 is configured with a current mirror type differential amplifier, and the pull-down driver 124 is configured with an NMOS transistor coupled between the internal voltage (VINT) terminal and a ground voltage (VSS) terminal and having a gate receiving the second driving signal V2 outputted from the second comparator 122.

When a sink current ISINK flows out through a load circuit (not shown), the internal voltage generator 100 enables the first internal voltage driving unit 110 to pull up, i.e., charge, the internal voltage (VINT) terminal. On the other hand, when an output current ISOURCE flows in from the load circuit (not shown), the internal voltage generator 100 enables the second internal voltage driving unit 120 to pull down, i.e., discharge, the internal voltage (VINT) terminal. That is, the internal voltage generator 100 detects the voltage level of the internal voltage (VINT) terminal and maintains the target voltage at a constant level.

The internal voltage generator having the above-described configuration, however, has the following problems.

As described above, the first and second comparators 112 and 122 are configured with a differential amplifier. In such a differential amplifier, an offset error may be caused by process variations in the fabrication process. In this case, a direct current path may be formed between the pull-up driver 114 and the pull-down driver 124, as indicated by an arrow P of FIG. 1. For example, when an offset error occurs in the first and second comparators 112 and 122 in such a situation that the internal voltage must be maintained at 0.65 V, an output voltage VOUT_UP of the first internal voltage driving unit 110 may become 0.66 V, and an output voltage VOUT_DN of the second internal voltage driving unit 120 may become 0.64 V. Thus, the direct current path P may be formed to cause a current flow from the output voltage (VOUT_UP) terminal of the first internal voltage driving unit 110 to the output voltage (VOUT_DN) terminal of the second internal voltage driving unit 120. In this case, the first internal voltage driving unit 110 continuously outputs a charge current from the power supply voltage (VDD) terminal in order to adjust the output voltage VINT of the internal voltage generator 100 to 0.66 V. On the other hand, the second internal voltage driving unit 120 continuously sinks a discharge current to the ground voltage (VSS) terminal in order to adjust the output voltage VINT of the internal voltage generator 100 to 0.64 V. Consequently, the internal voltage generator 100 causes unnecessary power consumption.

To solve those problems, the second reference voltage VREF_DN of the second internal voltage driving unit 120 is set to be higher than the first reference voltage VREF_UP of the first internal voltage driving unit 110. Generally, the second reference voltage VREF_DN is set to be higher than the first reference voltage VREF_UP by approximately 40 mV.

In this case, the direct current path P is not formed, but a dead-zone may be formed. As illustrated in FIG. 2, the dead-zone refers to a zone where the internal voltage VINT of the internal voltage generator 100 is randomly distributed between the first reference voltage VREF_UP and the second reference voltage VREF_DN. Specifically, when a load current ISOURCE or ISINK is 0, the internal voltage VINT of the internal voltage generator 100 is probabilistically distributed within the dead-zone.

If the dead-zone is formed, the internal voltage VINT is not targeted to the desired voltage level. Consequently, speed and jitter characteristics of the circuit using the internal voltage VINT are degraded, thus causing a reduction in the yield of the semiconductor device.

SUMMARY OF THE INVENTION

An embodiment of the present invention is directed to an internal voltage generator which prevents the formation of a dead-zone while preventing the formation of a direct current path.

In accordance with an embodiment of the present invention, an internal voltage generator includes: a detection unit configured to detect a level of an internal voltage in comparison to a reference voltage; a first driving unit configured to discharge an internal voltage terminal, through which the internal voltage is outputted, in response to an output signal of the detection unit; a current detection unit configured to detect a discharge current flowing through the first driving unit; and a second driving unit configured to charge the internal voltage terminal in response to an output signal of the current detection unit.

In accordance with another embodiment of the present invention, an internal voltage generator includes: a comparison unit configured to compare a reference voltage corresponding to a target level of an internal voltage with a fed-back voltage of the internal voltage; a first NMOS transistor coupled between a ground voltage terminal and an internal voltage terminal and having a gate receiving an output signal of the comparison unit, and configured to discharge the internal voltage terminal; a second NMOS transistor coupled between the ground voltage terminal and a detection node and having a gate receiving the output signal of the comparison unit; a first current source configured to output a first current to the detection node; and a third NMOS transistor coupled between the internal voltage terminal and a power supply voltage terminal and having a gate coupled to the detection node, and configured to charge the internal voltage terminal.

In accordance with yet another embodiment of the present invention, an internal voltage generator includes: a comparison unit configured to compare a reference voltage corresponding to a target level of an internal voltage with a fed-back voltage of the internal voltage; a first NMOS transistor coupled between a ground voltage terminal and an internal voltage terminal and having a gate receiving an output signal of the comparison unit, and configured to discharge the internal voltage terminal; a second NMOS transistor coupled between the ground voltage terminal and a first detection node and having a gate receiving the output signal of the comparison unit; a first current source configured to output a first current to the detection node; a third NMOS transistor coupled between the ground voltage terminal and a second detection node and having a gate coupled to the first detection node; a second current source configured to output a second current to the second detection node; and a PMOS transistor coupled between a power supply voltage terminal and the internal voltage terminal and having a gate coupled to the second detection node, and configured to charge the internal voltage terminal.

DESCRIPTION OF SPECIFIC EMBODIMENTS

Figure 1:
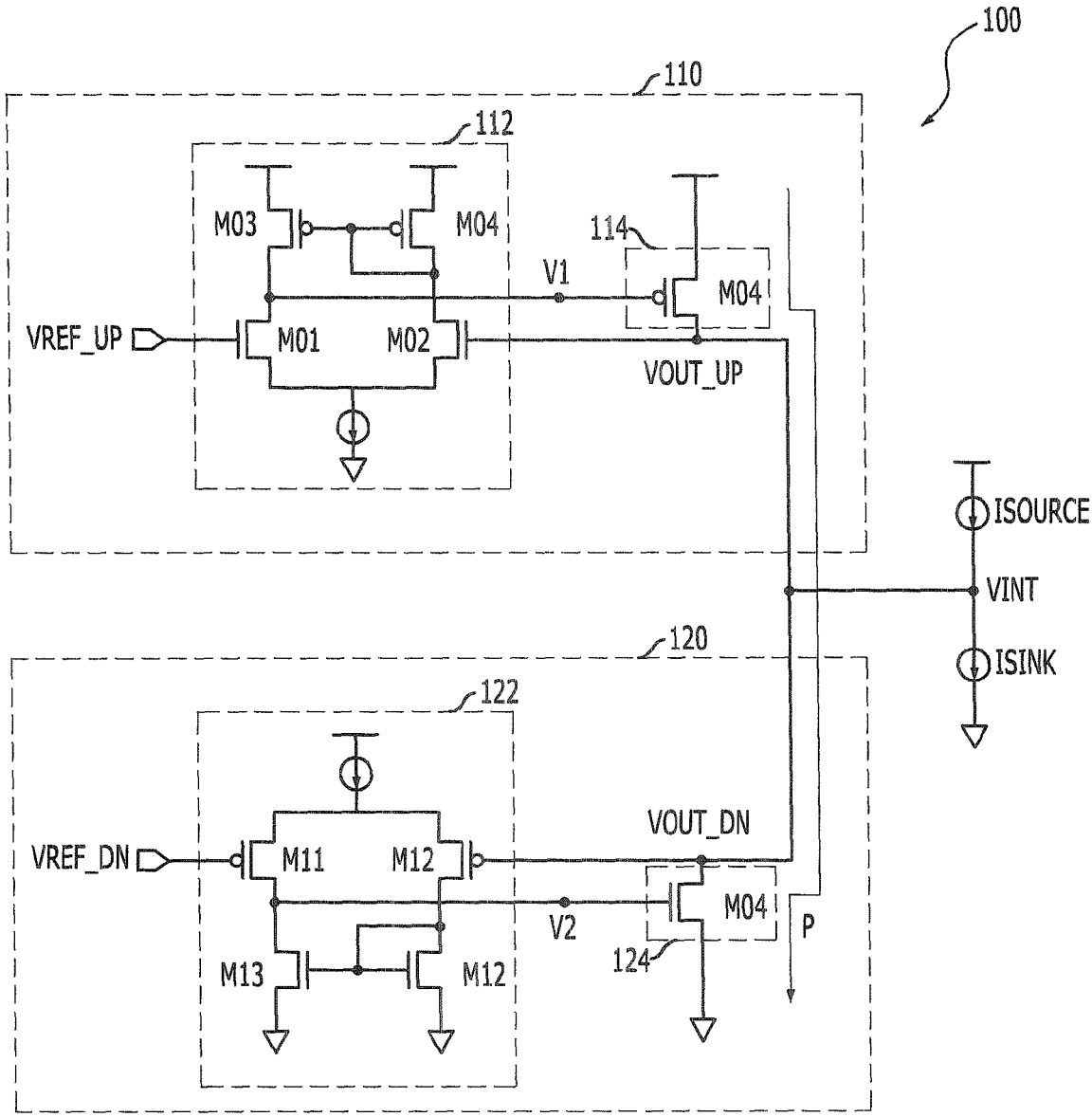
FIG. 1 (PRIOR ART)
FIG. 1 is a circuit diagram of a conventional internal voltage generator.
Figure 2:
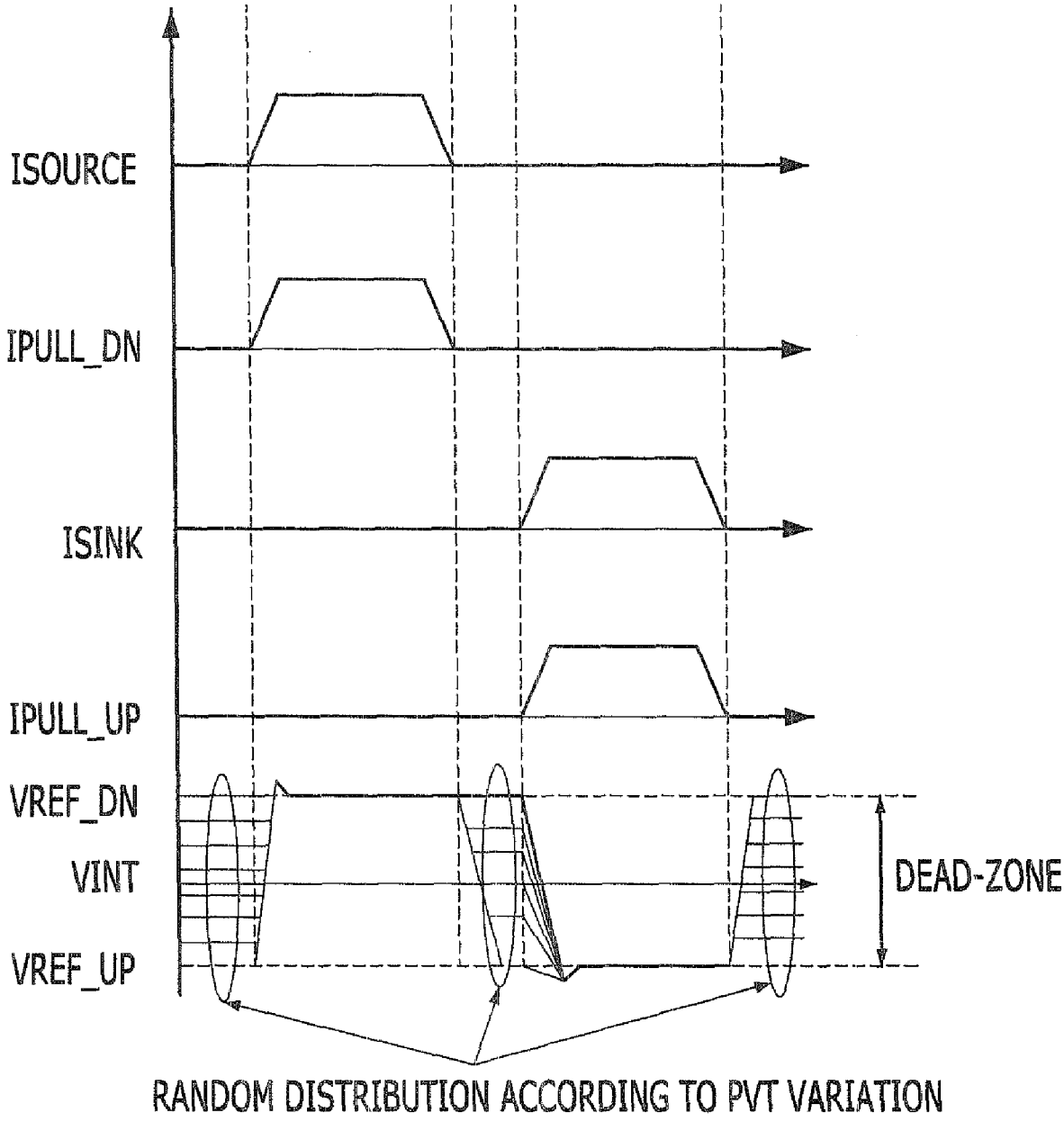
FIG. 2 (PRIOR ART)
FIG. 2 is a timing diagram illustrating pull-up/pull-down driving operations according to a load current generated in the internal voltage generator of FIG. 1.

Exemplary embodiments of the present invention are described below in more detail with reference to the accompanying drawings. The present invention may, however, be embodied in different forms and should not be constructed as being limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various drawing figures and embodiments of the present invention.

Figure 3:
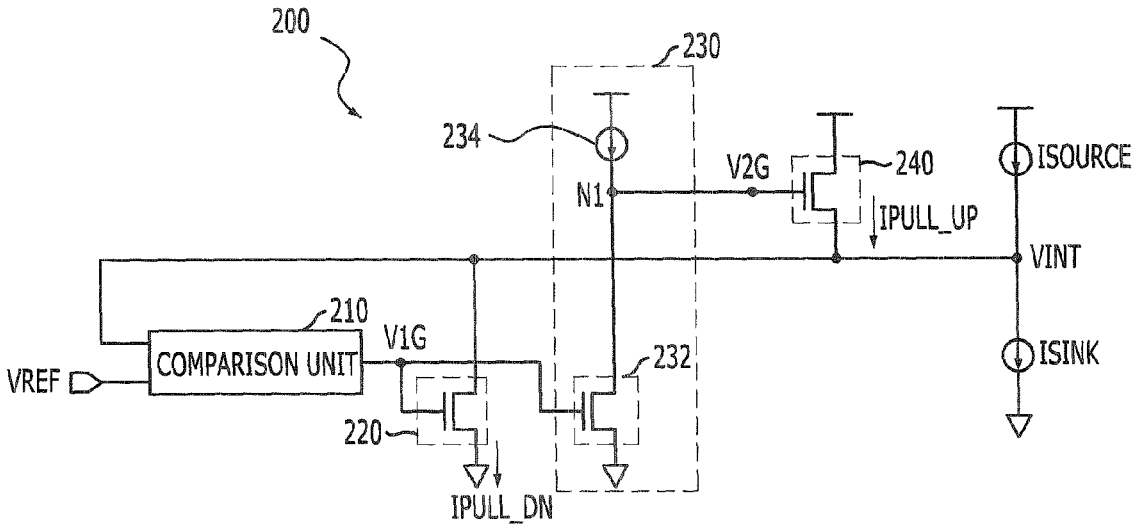
FIG. 3 is a circuit diagram of an internal voltage generator in accordance with a first embodiment of the present invention.

FIG. 3 is a circuit diagram of an internal voltage generator in accordance with a first embodiment of the present invention.

Referring to FIG. 3, an internal voltage generator 200 includes a comparison unit 210 configured to compare a reference voltage VREF and a fed-back internal voltage VINT. The reference voltage VREF corresponds to a target voltage level of an internal voltage. The comparison unit 210 is configured with a current mirror type differential amplifier.

The internal voltage generator 200 further includes a pull-down driving unit 220 configured to be driven according to the comparison result of the comparison unit 210. The pull-down driving unit 220 is configured with a first NMOS transistor coupled between a ground voltage (VSS) terminal and an internal voltage (VINT) terminal and having a gate receiving a first driving signal V1G outputted from the comparison unit 210. Hereinafter, the first NMOS transistor will be referred to as a pull-down NMOS transistor 220. When a load current ISOURCE flows in from a load circuit, the pull-down NMOS transistor 220 is turned on in response to the first driving signal V1G outputted from the comparison unit 210 so that the internal voltage (VINT) terminal is pulled down.

The internal voltage generator 200 further includes a current detection unit 230 configured to detect a discharge current IPULL_DN flowing through the pull-down NMOS transistor 220 and to control the operation of a pull-up driving unit 240, which will be described later, based on the detection result.

The current detection unit 230 is configured to mirror the discharge current IPULL_DN flowing through the pull-down NMOS transistor 220. The current detection unit 230 is configured with a second NMOS transistor 232 coupled between the ground voltage (VSS) terminal and a detection node N1 and having a gate receiving the first driving signal V1G outputted from the comparison unit 210. The second NMOS transistor 232 has a threshold voltage lower than the pull-down NMOS transistor 220. As the voltage level of the first driving signal V1G outputted from the comparison unit 210 gradually decreases, the pull-down NMOS transistor 220 is turned off earlier than the second NMOS transistor 232, and the second NMOS transistor 232 is then turned off after a preset time period has elapsed. When the second NMOS transistor 232 is turned off, the pull-down NMOS transistor 220 is fully turned off.

Moreover, the current detection unit 230 further includes a first current source 234 configured to output a first current to the first detection node N1. The first current output by the first current source 234 determines whether to drive the pull-up driving unit 240 according to whether the second NMOS transistor 232 is being driven.

The current detection unit 230 activates a second driving signal V2G for driving the pull-up driving unit 240 when the pull-down NMOS transistor 220 is fully turned off, that is, the discharge current IPULL_DN is '0'.

The current detection unit 230 further includes a pull-up driving unit 240 configured to be driven by the second driving signal V2G output by the current detection unit 230. The pull-up driving unit 240 is configured with a third NMOS transistor coupled between the power supply voltage (VDD) terminal and the internal voltage (VINT) terminal and having a gate coupled to the detection node N1. The third NMOS transistor pulls up the internal voltage (VINT) terminal. Hereinafter, the third NMOS transistor will be referred to as a pull-up NMOS transistor 240. When the load current ISINK is discharged, the pull-up NMOS transistor 240 is turned on in response to the second driving signal V2G outputted from the current detection unit 230, and supplies the charge current IPULL_UP to the internal voltage (VINT) current.

The operation of the internal voltage generator having the above-described configuration in accordance with the first embodiment of the present invention is described below in detail with reference to FIG. 4.

For convenience of explanation, it is assumed that the threshold voltage of the pull-down NMOS transistor 220 is 0.5 V, the threshold voltage of the second NMOS transistor 232 is 0.4 V, and the target voltage level of the internal voltage VINT is 0.6 V. Also, in the following description, as an example, when the voltage level of the internal voltage VINT maintains the target voltage level of 0.6 V as the comparison result, the comparison unit 210 maintains the first driving signal V1G at 0.45 V. It is noted that the voltage level described herein may be different from the practical experimental value.

Figure 4:
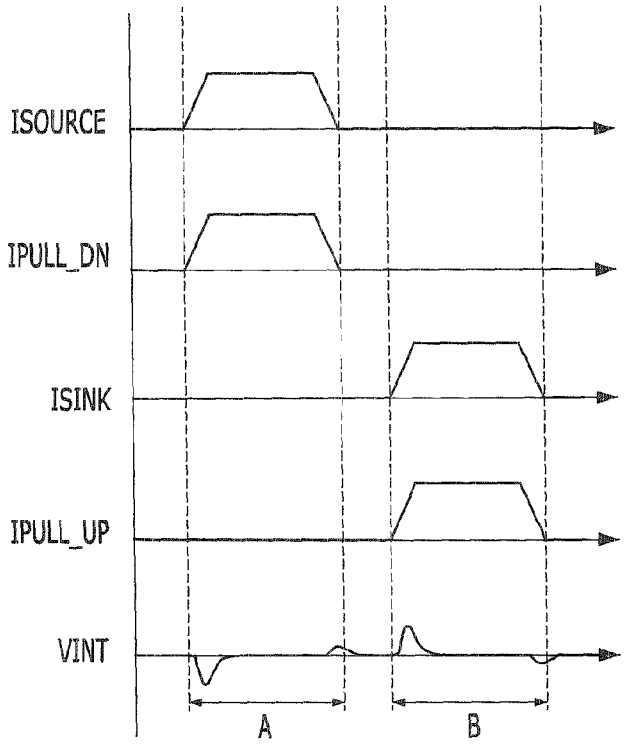
FIG. 4 is a timing diagram explaining pull-up/pull-down driving operations according to a load current generated in the internal voltage generator of FIG. 3.

FIG. 4 is a timing diagram explaining the pull-up/pull-down driving operations according to the load current generated in the internal voltage generator of FIG. 3.

Referring to FIG. 4, in a section A where the load current ISOURCE flows in, the comparison unit 210 compares the voltage level of the fed-back internal voltage VINT with the voltage level of the reference voltage VREF, and detects that the voltage level of the fed-back internal voltage VINT is higher than the voltage level of the reference voltage VREF. For example, as the load current ISOURCE flows in, the voltage level of the internal voltage VINT increases from 0.6 V to 0.61 V. Accordingly, the comparison unit 210 outputs the first driving signal V1G of a first voltage level (e.g., 0.5 V).

The pull-down NMOS transistor 220 is turned on in response to the first driving signal V1G of the first voltage level, which is outputted from the comparison unit 210.

The discharge current IPULL_DN corresponding to the load current ISOURCE is sunk to the ground voltage (VSS) terminal by the pull-down NMOS transistor 220, and the internal voltage VINT of 0.61 V is gradually adjusted to the reference voltage VREF of 0.60.

Meanwhile, the current detection unit 230 detects the discharge current IPULL_DN flowing through the pull-down NMOS transistor 220, and controls the pull-up NMOS transistor 240 not to be turned on. Specifically, the second NMOS transistor 232 is turned on, together with the pull-down NOMS transistor 220, in response to the first driving signal V1G of the first voltage level (0.5 V), which is outputted from the comparison unit 210. Since the first current output by the first current source 234 is sunk to the ground voltage (VSS) terminal, the voltage level of the first detection node N1 is lowered. Therefore, the second driving signal V2G of a logic low level is outputted.

Then, when the internal voltage VINT of 0.61 V reaches the reference voltage VREF of 0.6 V according to the pull-down driving operation of the pull-down NMOS transistor 220, the comparison unit 210 maintains the voltage level of the first driving signal V1G at 0.45 V. Therefore, the pull-down NMOS transistor 220 is turned off so that the pull-down driving operation is stopped. The second NMOS transistor 232 is kept in the turned-on state, so that the first current output by the first current source 234 is sunk to the ground voltage (VSS) terminal. That is, the comparison unit 210 outputs the first driving signal V1G having a voltage level (e.g., 0.45 V) ranging from the threshold voltage of the pull-down NMOS transistor 220 to the threshold voltage of the second NMOS transistor 232, so that the driving operations of both the pull-down NMOS transistor 220 and the pull-up NMOS transistor 240 are stopped.

Next, in a section B where the load current ISINK flows out, the comparison unit 210 detects that the fed-back internal voltage VINT is lower than the reference voltage VREF. For example, as the load current ISINK flows out, the voltage level of the internal voltage VINT decreases from 0.6 V to 0.59 V. Therefore, the comparison unit 210 outputs the first driving signal V1G of a voltage level (e.g., 0.38 V) lower than the threshold voltage of the second NMOS transistor 232.

The second NMOS transistor 232 is turned off and the second driving signal V2G of the logic high level is supplied to the gate of the pull-up NMOS transistor 240 according to the first current output by the first current source 234.

As the second driving signal V2G of the logic high level is supplied to the gate of the pull-up NMOS transistor 240, the pull-up NMOS transistor 240 is turned on, and the charge current IPULL_UP is supplied to the internal voltage (VINT) terminal. Since the pull-down NMOS transistor 220 is already fully off when the pull-up NMOS transistor 240 is pulled up, the direct current path is not formed.

Then, when the internal voltage VINT of 0.59 V reaches the reference voltage VREF of 0.6 V according to the pull-up driving operation of the pull-up NMOS transistor 240, the comparison unit 210 outputs the first driving signal V1G having a voltage level of 0.45 V. Therefore, only the second NMOS transistor 232 is turned on so that the first current output by the first current source 234 is sunk to the ground voltage (VSS) terminal. The second driving signal V2G transits to a logic low level, and the pull-up NMOS transistor 240 is turned off. Consequently, the pull-up driving operation is stopped. In such a state, as described above, the comparison unit 210 outputs the first driving signal V1G having a voltage level (e.g., 0.45 V) ranging from the threshold voltage of the pull-down NMOS transistor 220 to the threshold voltage of the second NMOS transistor 232, so that the driving operations of both the pull-down NMOS transistor 220 and the pull-up NMOS transistor 240 are stopped.

Figure 5:
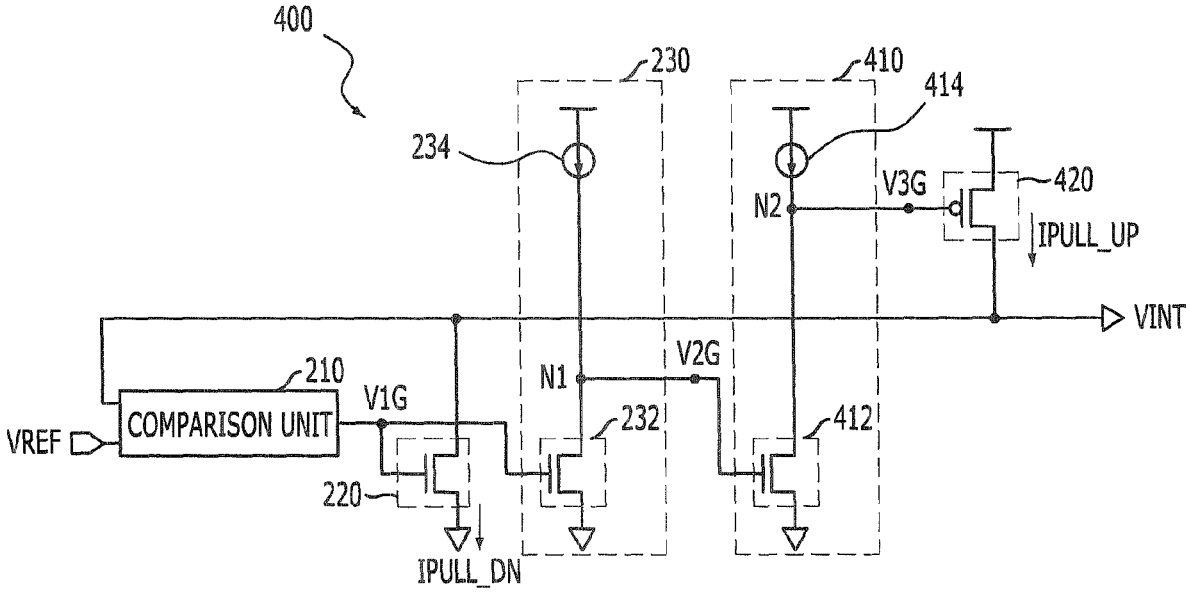
FIG. 5 is a circuit diagram of an internal voltage generator in accordance with a second embodiment of the present invention.

FIG. 5 is a circuit diagram of an internal voltage generator in accordance with a second embodiment of the present invention.

In comparison with the first embodiment, the pull-up driving unit of the second embodiment is configured with a PMOS transistor. In the following description, like reference numerals are used to refer to like elements, and different reference numerals are used to refer to different elements in the first embodiment and the second embodiment. For convenience of explanation, descriptions of elements of the second embodiment having the same configuration as those of the first embodiment have been omitted.

Referring to FIG. 5, an internal voltage generator 400 includes a driving control unit 410 configured to activate a third driving signal V3G according to the logic level of the second driving signal V2G from the current detection unit 230. The driving control unit 410 includes a fourth NMOS transistor 412 and a second current source 414. The fourth NMOS transistor 412 is coupled between the ground voltage (VSS) terminal and a second detection node N2 and has a gate coupled to the first detection node N1 of the current detection unit 230. The second current source 414 is configured to output a second current to the second detection node N2. The second current output by the second current source 414 determines whether to drive a pull-up PMOS transistor 420, which is described later, according to whether the fourth NMOS transistor 412 is being driven.

The driving control unit 410 activates the third driving signal V3G for driving the pull-up PMOS transistor 420 only when the pull-down NMOS transistor 220 is fully off, that is, the discharge current IPULL_DN flowing through the pull-down NMOS transistor 220 is 0 as the detection result of the current detection unit 230.

The internal voltage generator 400 further includes a pull-up PMOS transistor 420 configured to be driven according to the third driving signal V3G output by the driving control unit 410. The pull-up PMOS transistor 420 is coupled between the power supply voltage (VDD) terminal and the internal voltage (VINT) terminal and has a gate coupled to the second detection node N2, and is configured to charge the internal voltage (VINT) terminal.

The operation of the internal voltage generator having the above-described configuration in accordance with the second embodiment of the present invention is described below in detail with reference to FIG. 5.

For convenience of explanation, as with the first embodiment, it is assumed that the threshold voltage of the pull-down NMOS transistor 220 is 0.5 V, the threshold voltage of the second NMOS transistor 232 is 0.4 V, and the target voltage level of the internal voltage VINT is 0.6 V. Also, in the following description, as an example, when the voltage level of the internal voltage VINT maintains the target voltage level of 0.6 V as the comparison result, the comparison unit 210 maintains the first driving signal V1G of 0.45 V. It is noted that the voltage level described herein may be different.

First, the case where the load current ISOURCE flows in is described below.

In this case, the comparison unit 210 compares the voltage level of the fed-back internal voltage VINT with the voltage level of the reference voltage VREF, and detects that the voltage level of the fed-back internal voltage VINT is higher than the voltage level of the reference voltage VREF as the comparison result. For example, as the load current ISOURCE flows in, the voltage level of the internal voltage VINT increases from 0.6 V to 0.61 V. Therefore, the comparison unit 210 outputs the first driving signal V1G of a first voltage level (e.g., 0.5 V).

The pull-down NMOS transistor 220 is turned on in response to the first driving signal V1G of the first voltage level, which is outputted from the comparison unit 210.

The discharge current IPULL_DN corresponding to the load current ISOURCE is sunk to the ground voltage (VSS) terminal by the pull-down transistor 220. Thus, the internal voltage VINT of 0.61 V is gradually adjusted to the reference voltage VREF of 0.60 V.

The current detection unit 230 detects the discharge current IPULL_DN flowing through the pull-down NMOS transistor 220, and outputs the second driving signal V2G of a logic low level. Specifically, the second NMOS transistor 232 is turned on, together with the pull-down NOMS transistor 220, in response to the first driving signal V1G of the first voltage level (0.5 V), which is outputted from the comparison unit 210. Since the first current output by the first current source 234 is sunk to the ground voltage (VSS) terminal, the voltage level of the first detection node N1 is lowered. Therefore, the second driving signal V2G of a logic low level is outputted.

Then, the driving control unit 410 receives the second driving signal V2G of the logic low level, which is outputted from the current detection unit 230, and outputs the third driving signal V3G of the logic high level to the pull-up PMOS transistor 420. In other words, the fourth NMOS transistor 412 is turned off in response to the second driving signal V2G of the logic low level, which is outputted from the current detection unit 230. The third driving signal V3G of the logic high level is supplied to the gate of the pull-up PMOS transistor 420 by the second current output by the second current source 414.

The pull-up PMOS transistor 420 remains turned-off by the third driving signal V3G of the logic high level, which is output by the driving control unit 410.

Therefore, the pull-up PMOS transistor 420 does not perform the pull-up driving operation while the pull-down NMOS transistor 220 pulls down the internal voltage (VINT) terminal.

When the internal voltage VINT of 0.61 V reaches the reference voltage VREF of 0.6 V according to the pull-down driving operation of the pull-down NMOS transistor 220, the comparison unit 210 maintains the voltage level of the first driving signal V1G at 0.45 V. Therefore, the pull-down NMOS transistor 220 is turned off so that the pull-down driving operation is stopped. The second NMOS transistor 232 remains turned-on, so that the first current output by the first current source 234 is sunk to the ground voltage (VSS) terminal. That is, the comparison unit 210 outputs the first driving signal V1G having a voltage level (e.g., 0.45 V) ranging from the threshold voltage of the pull-down NMOS transistor 220 to the threshold voltage of the second NMOS transistor 232, so that the driving operations of both the pull-down NMOS transistor 220 and the pull-up PMOS transistor 420 are stopped.

Next, the case where the load current ISINK flows out is described.

In this case, the comparison unit 210 detects that the fed-back internal voltage VINT is lower than the reference voltage VREF. For example, as the load current ISINK flows out, the voltage level of the internal voltage VINT decreases from 0.6 V to 0.59 V. Therefore, the comparison unit 210 outputs the first driving signal V1G of a voltage level (e.g., 0.38 V) lower than the threshold voltage of the second NMOS transistor 232.

The second NMOS transistor 232 is turned off and the second driving signal V2G of the logic high level is supplied to the gate of the fourth NMOS transistor 412 by the first current output by the first current source 234.

As the second driving signal V2G of the logic high level is supplied to the gate of the fourth NMOS transistor 412, the second current output by the second current source 414 sinks to the ground voltage (VSS) terminal. Thus, the third driving signal V3G of the logic low level is supplied to the gate of the pull-up PMOS transistor 420.

Therefore, the pull-up PMOS transistor 420 is turned on to charge the internal voltage (VINT) terminal. Since the pull-down NMOS transistor 220 is already fully off when the pull-up PMOS transistor 420 is pulled up, the direct current path is not formed.

Then, when the internal voltage VINT of 0.59 V reaches the reference voltage VREF of 0.6 V due to the pull-up driving operation of the pull-up PMOS transistor 420, the comparison unit 210 outputs the first driving signal V1G having a voltage level of 0.45 V. Therefore, only the second NMOS transistor 232 is turned on so that the first current output by the first current source 234 sinks to the ground voltage (VSS) terminal. The second driving signal V2G transits to a logic low level, and the fourth NMOS transistor 412 is turned off. Consequently, the third driving signal V3G of the logic high level is supplied to the gate of the pull-up PMOS transistor 420 by the second current output by the second current source 414. The pull-up PMOS transistor 420 is turned off in response to the supplied third driving signal V3G of the logic high level. Hence, the pull-up driving operation is stopped. In such a state, as described above, the driving operations of both the pull-down NMOS transistor 220 and the pull-up PMOS transistor 420 are stopped.

In accordance with the exemplary embodiments of the present invention, the pull-down driving unit and the pull-up driving unit are separately driven using the single comparison unit. Therefore, the dead-zone is minimized while preventing the formation of the direct current path caused by the offset error, thereby maintaining the internal voltage VINT at a constant voltage level. Consequently, unnecessary power consumption is minimized.

Furthermore, the internal voltage is targeted to the target voltage level, without a dead-zone. Hence, the internal voltage is maintained at the constant voltage level, without regard to the load current. Consequently, the operational reliability of the internal voltage generator is improved.

While the present invention has been described with respect to specific embodiments, it will be apparent to those skilled in the art that various changes and modifications may be made without departing from the spirit and scope of the present invention as defined by the following claims.

Although it has been described that the internal voltage generator in accordance with the exemplary embodiment of the present invention determines whether to drive the pull-up driving unit according to whether the pull-down driving unit is being driven, the present invention is not limited thereto. For example, the internal voltage generator may be configured to determine whether to drive the pull-down driving unit according to whether the pull-up driving unit is being driven.

What is claimed is:

1. An internal voltage generator, comprising:

a detection unit configured to detect a level of an internal voltage in comparison to a reference voltage and output a first driving signal in response to the detection;

a first driving unit configured to receive the first driving signal and discharge an internal voltage terminal, through which the internal voltage is outputted, in response to the first driving signal;

a current detection unit configured to receive the first driving signal, detect, in response to the first driving signal, a discharge current flowing through the first driving unit, and output a second driving signal in response to the detection of the discharge current; and a second driving unit configured to charge the internal voltage terminal in response to the second driving signal.

2. The internal voltage generator of claim 1, wherein the detection unit comprises a comparison unit configured to compare the reference voltage corresponding to a target level of the internal voltage with a fed-back voltage of the internal voltage.

3. The internal voltage generator of claim 1, wherein the current detection unit is configured to mirror the discharge current flowing through the first driving unit and to control the second driving unit.

4. The internal voltage generator of claim 3, wherein the current detection unit is configured to adjust a voltage level of the second driving signal according to the discharge current flowing through the first driving unit.

5. The internal voltage generator of claim 1, wherein the first driving unit comprises:

a first NMOS transistor coupled between a ground voltage terminal and the internal voltage terminal and having a gate receiving the first driving signal.

6. The internal voltage generator of claim 5, wherein the current detection unit comprises:

a second NMOS transistor coupled between the ground voltage terminal and a detection node and having a gate receiving the first driving signal; and a first current source configured to output the second driving signal to the detection node.

7. The internal voltage generator of claim 6, wherein a threshold voltage of the second NMOS transistor is lower than a threshold voltage of the first NMOS transistor.

8. The internal voltage generator of claim 5, wherein the current detection unit comprises:

a second NMOS transistor coupled between the ground voltage terminal and a first detection node and having a gate receiving an output signal of the detection unit;

a first current source configured to output a first current to the first detection node;

a third NMOS transistor coupled between the ground voltage terminal and a second detection node and having a gate coupled to the first detection node; and a second current source configured to output a second current to the second detection node.

9. The internal voltage generator of claim 8, wherein a threshold voltage of the second NMOS transistor is lower than a threshold voltage of the first NMOS transistor.

10. The internal voltage generator of claim 1, wherein the second driving unit is configured to charge the internal voltage terminal in response to a zero discharge current flowing through the first driving unit being detected by the current detection unit.

11. An internal voltage generator, comprising:

a comparison unit configured to compare a reference voltage corresponding to a target level of an internal voltage with a fed-back voltage of the internal voltage;

a first NMOS transistor coupled between a ground voltage terminal and an internal voltage terminal and having a gate receiving an output signal of the comparison unit, and configured to discharge the internal voltage terminal;

a second NMOS transistor coupled between the ground voltage terminal and a detection node and having a gate receiving the output signal of the comparison unit;

a first current source configured to output a first current to the detection node; and a third NMOS transistor coupled between the internal voltage terminal and a power supply voltage terminal and having a gate coupled to the detection node, and configured to charge the internal voltage terminal.

12. The internal voltage generator of claim 11, wherein a threshold voltage of the second NMOS transistor is lower than a threshold voltage of the first NMOS transistor.

13. The internal voltage generator of claim 1, wherein the current detection unit comprises:

an NMOS transistor coupled between a ground voltage terminal and a detection node and having a gate configured to receive the first driving signal; and a first current source coupled to the NMOS transistor and configured to output the second driving signal to the detection node.

14. The internal voltage generator of claim 1, wherein the current detection unit is configured to activate the second driving signal when the discharge current flowing through the first driving unit becomes substantially zero.

* * * * *